US005198089A

United States Patent [19]

Brueggman

[11] Patent Number: 5,198,089

[45] Date of Patent: Mar. 30, 1993

[54] PLATING TANK

[75] Inventor: Michael A. Brueggman, Mountain View, Calif.

[73] Assignee: National Semiconductor Corporation, Santa Clara, Calif.

[21] Appl. No.: 784,533

[22] Filed: Oct. 29, 1991

[51] Int. Cl.[5] ..... C25D 17/00; C25D 17/04; C25D 21/06

[52] U.S. Cl. ..... 204/240; 204/275; 204/297 W; 204/263

[58] Field of Search ..... 204/275, 263, 240, 297 W

[56] References Cited

U.S. PATENT DOCUMENTS 2,362,228 11/1944 Wright ..... 204/297 W X
2,861,936 11/1958 Colasanto ..... 204/297 W X
3,634,047 1/1972 Faulkner ..... 204/263 X
4,339,319 7/1982 Aigo ..... 204/275 X
4,696,729 9/1987 Santini ..... 204/275 X

*Primary Examiner*—Donald R. Valentine
*Attorney, Agent, or Firm*—Steven F. Caserza

[57] ABSTRACT

An improved plating tank having a tank separator which segregates the tank into an upper tank and a lower tank. A plating chamber attached to the tank separator encases a rack having one or more surfaces for supporting semiconductor wafers to be plated. A chamber passage formed of an inner surface of the chamber is connected between an opening in the tank separator and the upper tank to allow solution pumped from the lower tank to the upper tank to pass through the tank separator opening into the chamber passage and to flow over the anodes and the wafers.

18 Claims, 3 Drawing Sheets

PLATING TANK

TECHNICAL FIELD

The present invention relates to electroplating devices for electroplating semiconductor wafers.

BACKGROUND

Some form of plating is often used in the processing of semiconductor wafers to deposit multiple layers of conductive metals on a semiconductor wafer for forming electrically conductive regions such as, for example, metal bumps for bonding. Multiple wafers are often processed at one time during the plating processing of semiconductor wafers. It is therefore desirable that the plating apparatus used plates wafers quickly and efficiently.

Plating involves the deposition of an adherent metallic layer onto a conductive object, such as a semiconductor wafer, by placing the wafer into an electrolytic bath composed of a salt solution consisting of the metal to be plated onto the wafer. Two plating techniques are known. Electroplating is a plating technique which passes a DC current through the solution to affect the transfer of metal ions onto the cathodic surface of the conductive object. Another plating technique is known as electroless plating which proceeds by an exchange of reaction between the metal complexes in a solution and the particular metal to be plated without requiring an externally applied electric current.

FIGS. 1-3 illustrate two prior art plating tanks. FIG. 1 shows an example of a rack plating tank 10 having one or more fluid nozzles 14 for fluid agitation located near the bottom of tank 10 between an anode 12 and a rack 16. FIG. 2 shows an example of rack 16, which supports one or more semiconductor wafers 18 of the same or different sizes on one or more surface 22 of rack 16. Not shown are probes which carry electric current to cathodes on the wafer 18 through an opening in the photoresist on the face of wafer. Salt solution 24 is forced over the wafers to provide agitation between the wafer and the solution. Rack 16 can be mechanically moved in salt solution 24 to increase the aggregation of the salt solution to the cathodic surfaces on the wafers. Rack plating tank 10 has a simple set-up which accommodates easily different sizes and quantities of wafers to be electroplated. However, spacing the anodes 12 away from wafers 18 to allow for fluid nozzles 14 reduces the anode efficiency of metal transfers and thus also reduces the efficiency of plating tank 10.

FIG. 3 is an example of a cross-sectional view of a prior art fountain plating tank 30 implementing one or more plating stations 32 with each plating station accommodating a wafer 18 placed perpendicular to a flow of a salt solution. Each plating station 32 has a round vertical tube 34 slightly wider than the diameter of wafer 18, with an anode placed close to and parallel to wafer surface. Wafer 18 is supported between the top edges of tube 34 with contact tips 38. Gap 39 is formed between the wafer edge and the top edge of tube 34. One or more contact tips 38 are placed between the wafer edge and the top edge of tube 34, to bridge gap 39 while allowing a flow 14 of salt solution 24 between wafer 18 and the top edge of tube 34. Gap 39 is critical for providing a proper flow rate 14 of the salt solution. This gap has to be duplicated accurately on all plating stations 32 to obtain identical flow rates between all plating stations in the system. Each wafer 18 must also be placed parallel to a fluid level 36 of salt solution 24 contained within tube 34. The walls of tube 34 must be perpendicular to wafer 18 while parallel to each other to ensure that fluid flow 14 is perpendicular to wafer 18. To electroplate wafer 18, an electrical contact is made through contact tips 38 to cathodes on wafer 18 as solution 24 is pumped up tube 34 to flow over wafer 18. This provides very efficient contact of the solution with the cathodic metal on the contact tips and wafers.

Fountain plating tank 30 provides high agitation efficiency between the solution and each wafer. However, to provide proper fluid flow, each plating station set-up in tank 30 must be precisely duplicated throughout the fountain plating system to ensure identical flow rate to each station. This requires that all stations in the plating tank to contain a wafer 18 even if the wafer need not be electroplated. The fountain plating tank 30 is therefore inefficient for reasons that it requires one wafer per station, and that it is difficult to modify for electroplating wafers of different sizes without changing each wafer station in the tank.

A more efficient plating tank is needed that combines the aggregation efficiency of the fountain plater with the flexibility in processing different quantities and sizes of wafers of the rack platers.

SUMMARY OF THE INVENTION

An improved plating tank is taught that allows the anodes to be placed closer to the cathodes of the semiconductor wafers and provides flexibility in accommodating various sizes and number of wafers to be plated, while providing efficient metal transfer between solution and wafer surface. A plating tank is provided having a tank separator which segregates the tank into an upper tank and a lower tank. A plating chamber attached to the tank separator encases a rack having one or more surfaces for supporting semiconductor wafers to be plated. A chamber passage formed of an inner surface of the chamber is connected between an opening in the tank separator and the upper tank to allow solution pumped from the lower tank to the upper tank to pass through the tank separator opening into the chamber passage and to flow over the anodes and the wafers.

DESCRIPTION OF THE SPECIFIC EMBODIMENTS

Figure 1:
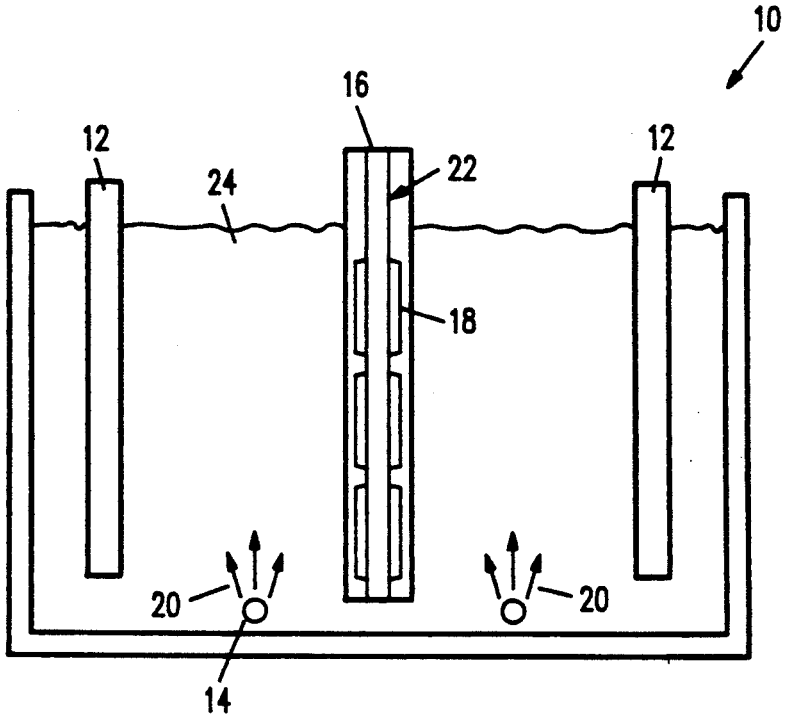
PRIOR ART FIG. 1
FIG. 1 illustrates a cross-sectional view of a prior art electroplating tank using a rack technique for supporting one or more semiconductor wafers to be electroplated.
Figure 2:
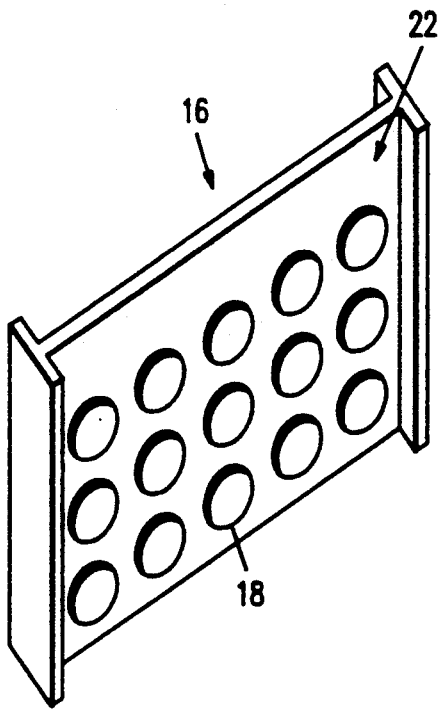
PRIOR ART FIG. 2
FIG. 2 illustrates a perspective view of a rack used in the prior art electroplating tank of FIG. 1.
Figure 3:
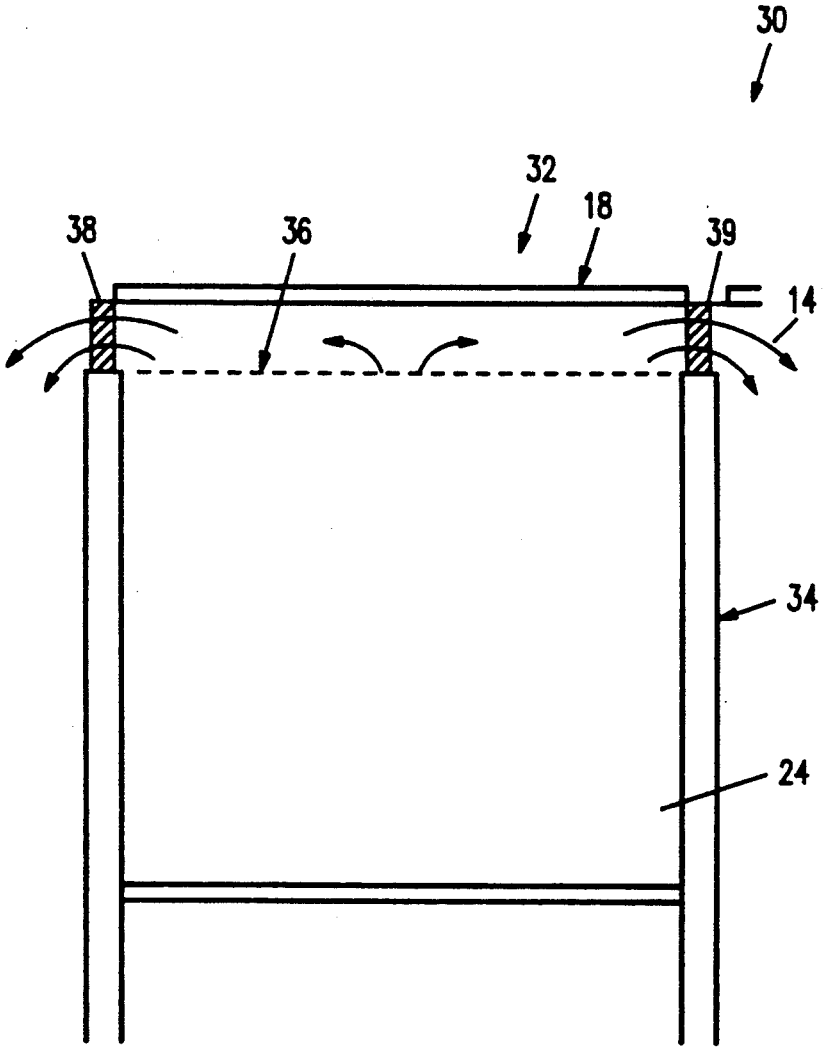
PRIOR ART FIG. 3
FIG. 3 illustrates a cross-sectional view of a prior art electroplating tank using a fountain technique.
Figure 4:
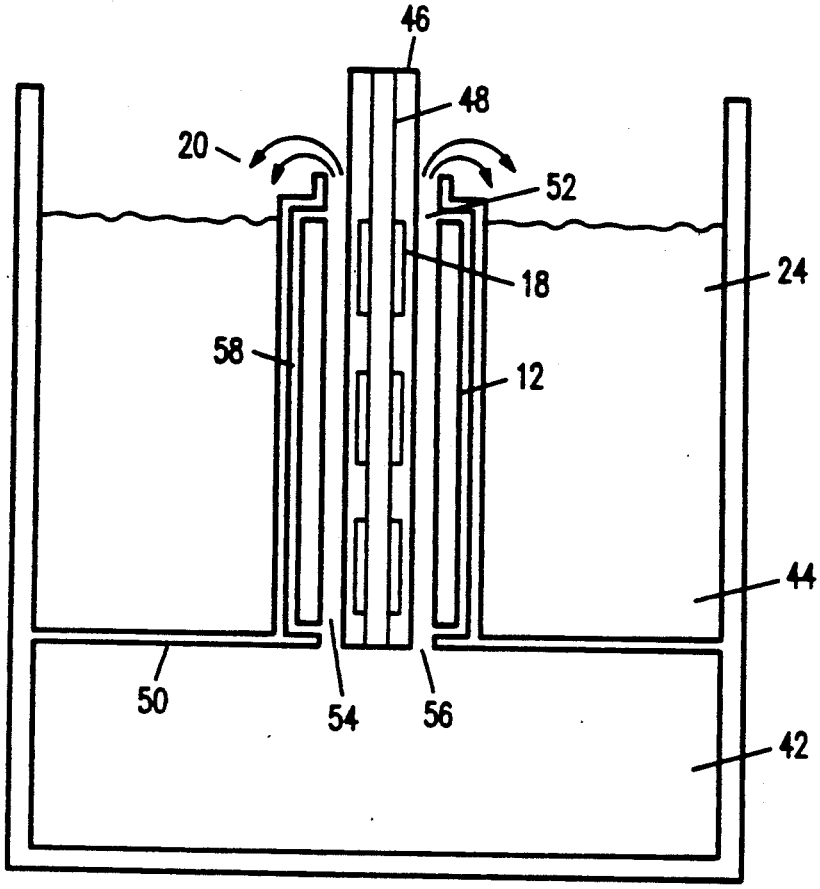
FIG. 4 illustrates a cross-sectional view of a preferred embodiment of an electroplating tank device made in accordance with and embodying the principles of the present invention.
Figure 5:
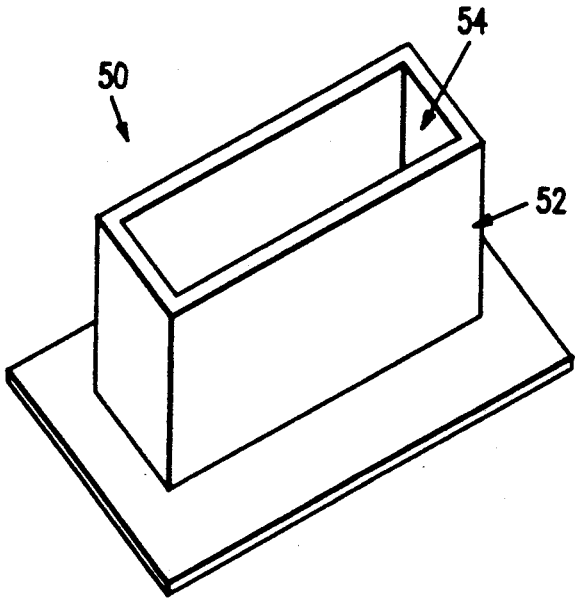
FIG. 5 illustrates a perspective view of a tank separator having a chamber of the electroplating tank device shown in FIG. 4.

FIG. 4 shows one embodiment of plating tank 40 described in accordance with the principles of this invention. Tank separator 50, also shown in FIG. 5, divides tank 40 into lower tank 42 and upper tank 44. Tank separator 50 has outer passage 56 to allow a flow of a salt solution 24 from lower tank 42 into upper tank 44. Although not shown, a pump may be coupled to lower tank 42 to provide filtering means for solution 24 as it passes between the upper and lower tanks. Chamber 52 attached to tank separator 50 protrudes into upper tank 44. Chamber 52 encases one or more wafers 18 in a chamber passage 54 formed from an inner surface 58 of chamber 52. Wafers 18 are preferably supported on one or more surfaces 48 on a rack 46, placed inside chamber 52. Inner surface 58 facing parallel to surfaces 48 has one or more anodes 12 parallel to wafers 18. Chamber passage 54 is connected to outer passage 56 in tank separator 50 to allow a flow of fluid from lower tank 42 through chamber passage 54 and into upper tank 44. To electroplate wafers 18, probes may be attached to wafers 18 to supply an electrical current to cathodes on wafers 18, while solution 24 is pumped from lower tank 42 through outer passage 56, and into chamber passage 54 to efficiently agitate the solution over the wafers 18.

Rack 46 may easily be designed to accommodates different sizes and number of wafers to be plated. No modification to the plating tank 40 is required to change wafer size and wafer quantity. Restricting the volume of the solution through the narrow chamber passage together with proper pumping pressure forces the solution over the wafers with sufficient agitation to obviate the need for fluid nozzles or mechanical agitators.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. An electroplating tank containing solution to electroplate one or more semiconductor wafers having a cathodic surface, said tank comprising:

an upper tank;

a lower tank; and a chamber located in said upper tank for encasing one or more racks for supporting said wafers, wherein said chamber comprises:

an inner surface, said inner surface having one or more anodes, said anodes facing said plurality of wafers supported on said one or more racks; and a fluid passage between said lower tank and said upper tank to allow a flow of said solution from said lower tank through said chamber, laterally across a surface of said anodes and a surface of said plurality of wafers, and into said upper tank.

2. An electroplating tank of claim 1 wherein said lower tank further comprises a pump to adjust a flow rate of said solution over said plurality of wafers.

3. An electroplating tank of claim 1 wherein said lower tank further comprises filtering means.

4. An electroplating tank of claim 1 wherein said chamber further comprises one or more removable racks for supporting said plurality of wafers.

5. An electroplating tank of claim 4 wherein said one or more racks further comprises one or more surfaces for supporting said wafers and providing an electrical current to said wafers.

6. An electroplating tank of claim 1 wherein said inner surface form a chamber passage to allow a flow of fluid from said lower tank to said upper tank.

7. An electroplating tank containing a solution for electroplating one or more semiconductor wafers, said tank comprising:

a horizontal tank separator, said separator dividing said tank into an upper tank and a lower tank, said separator having means to conduct a flow of fluid between said lower tank and said upper tank; and a chamber in said upper tank for encasing one or more racks for supporting said wafers, wherein said chamber comprises:

an inner surface, said inner surface having one or more anodes; and an inner fluid passage, said inner fluid passage connected to said means to conduct a flow of fluid between said lower tank and said upper tank to allow said solution to flow over said anodes and said wafers.

8. An electroplating tank of claim 7 wherein said means to conduct a flow of fluid comprises a fluid passage between said lower tank and said upper tank.

9. An electroplating tank of claim 7 wherein said means to conduct a flow of fluid further comprises a pump.

10. An electroplating tank of claim 7 wherein said means to conduct a flow of fluid further comprises filtering means.

11. An electroplating tank of claim 7 wherein said chamber further comprises one or more removable racks for supporting said wafers.

12. An electroplating tank of claim 11 wherein said one or more racks further comprises one or more surfaces for supporting said wafers and providing an electrical current to said wafers.

13. An electroplating tank of claim 7 wherein a width and a length of said chamber passage is substantially smaller than a width and a length of said lower tank.

14. An electroplating tank containing solution to electroplate one or more semiconductor wafers having a cathodic surface, said tank comprising:

an upper tank;

a lower tank; and a chamber located in said upper tank for encasing one or more racks for supporting said wafers, wherein said chamber comprises:

an inner surface, said inner surface having one ore more anodes, said anodes facing said plurality of wafers supported on said one or more racks;

a fluid passage between said lower tank and said upper tank to allow a flow of said solution from said lower tank through said chamber, over said anodes said plurality of wafers, and into said upper tank; and one or more removable racks for supporting said plurality of wafers.

15. An electroplating tank of claim 14 wherein said one or more racks further comprises one or more surfaces for supporting said wafers and providing an electrical current to said wafers.

16. An electroplating tank of claim 14 wherein said lower tank further comprises a pump to adjust a flow rate of said solution over said plurality of wafers.

17. An electroplating tank of claim 14 wherein said lower tank further comprises filtering means.

18. An electroplating tank of claim 14 wherein said inner surface forms a chamber passage to allow a flow of fluid from said lower tank to said upper tank.

* * * * *